US007677935B2

(12) United States Patent
Ogata et al.

(10) Patent No.: US 7,677,935 B2
(45) Date of Patent: Mar. 16, 2010

(54) RIGHT-ANGLE CONNECTOR

(75) Inventors: Shigetoshi Ogata, Toyama (JP); Mieko Kano, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/256,626

(22) Filed: Oct. 23, 2008

(65) Prior Publication Data

US 2009/0246996 A1 Oct. 1, 2009

(30) Foreign Application Priority Data

Mar. 25, 2008 (JP) ..... 2008-078355

(51) Int. Cl.
*H01R 13/187* (2006.01)

(52) U.S. Cl. ..... 439/845; 439/871

(58) Field of Classification Search ..... 439/871, 439/830, 845, 881, 224, 181
See application file for complete search history.

(56) References Cited

U.S. PATENT DOCUMENTS 5,564,952 A * 10/1996 Davis ..... 439/682
6,196,885 B1 * 3/2001 Catalino et al. ..... 439/881
6,276,960 B1 * 8/2001 Schaefer et al. ..... 439/522

FOREIGN PATENT DOCUMENTS

JP 2003-123894 A 4/2003

* cited by examiner

*Primary Examiner*—Ross N Gushi
(74) *Attorney, Agent, or Firm*—Darby & Darby P.C.

(57) ABSTRACT

A connector forms a connection by inserting a socket connector and a plug connector into a housing. The housing is configured by integrally forming a plug insertion recessed part and a socket insertion recessed part in an L shape. A socket terminal of the socket connector, which is inserted in a socket insertion recessed part, is connected to and pinched by a plug terminal of the plug connector, which is inserted in and attached to the plug insertion recessed part.

11 Claims, 10 Drawing Sheets

Figure 6(a)
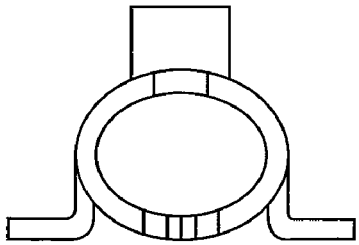
Figure 6(b)
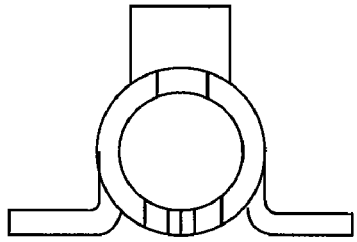
Figure 6(c)
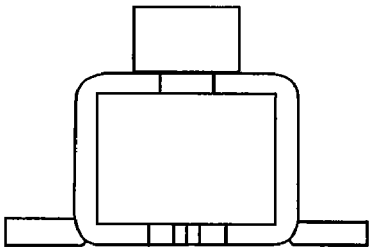
Figure 6(d)
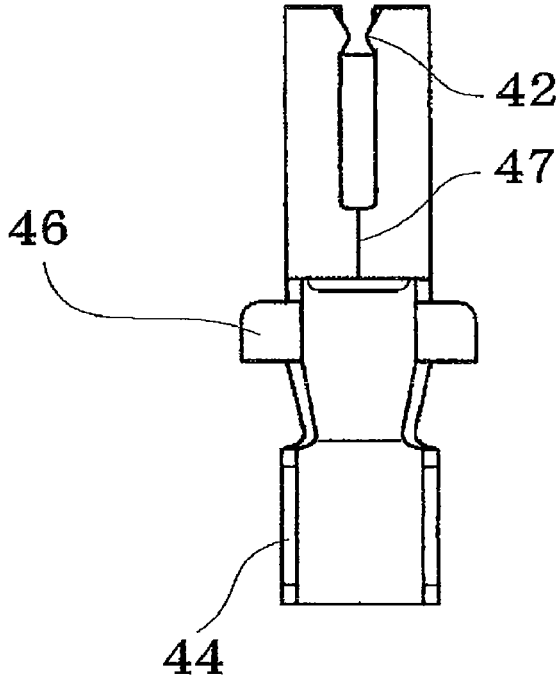
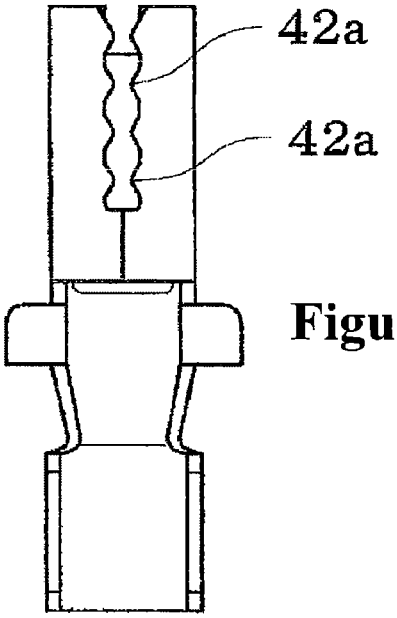
Figure 6(e)

RIGHT-ANGLE CONNECTOR

CROSS-REFERENCE TO RELATED APPLICATION

This application claims the benefit under 35 U.S.C. §119 of Japanese Patent Application No. JP 2008-078355, which was filed on Mar. 25, 2008 and is incorporated by reference in its entirety herein.

FIELD OF THE INVENTION

The present invention relates to a high voltage connector.

BACKGROUND OF THE INVENTION

The light source lamp of, for example, a projector requires the application of a high voltage of 9-30 KV, and therefore a high voltage connector is used to connect the light source lamp to the power supply.

Attendant with the demand for a high voltage connector that has a high withstand voltage, there is a need to prevent surface leakage and space leakage from occurring.

Well-known examples of conventional high voltage connectors include the straight type shown in FIG. 9 and the L shaped type shown in FIG. 10, disclosed by Japanese Unexamined Patent Application Publication No. 2003-123894.

With a straight type connector 100 shown in FIG. 9, a plug pin 131 of a plug connector 130 and a socket terminal 141 of a socket connector 140 are connected in a straight line, as shown by the structure in FIG. 9(*b*), and the pull-out directions of wires 135, 145 are also oriented in a straight line; therefore, the wires 135, 145 inside the electronic equipment case are installed by bending them, and consequently there are problems in that not only is a large space required, but a large load is applied to the bent parts of the wires.

As shown in FIG. 10, a connector 200 has a structure wherein a wire crimping part of a plug pin 231 of a plug connector 230 is provided in a direction that is at a right angle to the plug pin 23 1, and a wire 235 is pulled out in the right angle direction and is connected to a socket terminal 241 of a socket connector 240. However, because the wire of the plug pin 231 is pulled out in a right angle direction, there are problems in that it is not only necessary to provide a cover 232 in order to prevent surface leakage at the wire crimping part 231 from occurring, but it is also necessary to secure a gap between the cover 232 and the plug connector 230 that extends over the distance of a surface, causing the length L0 of connector 200 to be extended.

SUMMARY OF THE INVENTION

The present invention considers the above background art, and it is an object of the present invention to more effectively provide a connector that is more compact and whereto a high voltage is impressed.

A connector according to a first aspect of the invention is a connector that forms a connection by inserting a socket connector and a plug connector into a housing, wherein the housing is configured by integrally forming a plug insertion recessed part and a socket insertion recessed part in an L shape; and a socket terminal of the socket connector, which is inserted in the socket insertion recessed part, is connected to and pinched by a plug terminal of the plug connector, which is inserted in and attached to the plug insertion recessed part.

Thus, a structure is adopted wherein the housing is configured by integrally forming the plug insertion recessed part and the socket insertion recessed part in an L shape (at a right angle), which makes it possible to secure a sufficient surface distance with a single-piece housing; therefore, the cover member as shown in the conventional example is unnecessary.

A connector according to a second aspect of the invention is a connector wherein the plug terminal has a contact part, which is pinched by and connected to the socket terminal, and a wire connecting part; the contact part and the wire connecting part are integrally formed from a plate material; and the contact part is formed by folding a plate material so that it is doubled.

The plug terminal is integrally formed from the plate material and has increased thickness because it is formed by folding the contact part so that it is doubled; thereby, the contact stability between the socket terminal and the pinch contact part is improved.

In addition, forming the plug terminal from the plate material also makes it easy to configure the wire connecting part using a crimping connection structure.

A connector according to a third aspect of the invention is a connector wherein the plug terminal has a latch; and when the plug terminal is inserted in and attached to the plug insertion recessed part of the housing, it is latched to a latching part, which is provided to the housing.

Forming the plug terminal from the plate material also makes it easy to form the latch by bending a part thereof; furthermore, forming the latch improves attachability and assembly characteristics with respect to the housing.

A connector according to a fourth aspect of the invention is a connector wherein the socket terminal comprises a pinch contact part, which pinches and connects to the plug terminal, and a wire connecting part; the pinch connecting part and the wire connecting part are integrally formed from a plate material; and the pinch contact part is formed by folding a plate material into a tubular shape and forms the pinch contact part of the plug terminal.

Forming the socket terminal from the plate material and forming the pinch connecting part, which pinches the plug terminal, by folding the plate material into a tubular shape makes it easy to form the pinch connecting part at the mating part; furthermore, the tubular shape improves contact stability.

A connector according to a fifth aspect of the invention is a connector wherein the base side of the pinch contact part, which is formed by folding the plate material into a tubular shape and forms the pinch contact part of the plug terminal, is mated with the plate material.

Mating the socket terminal to the base side of the pinch connecting part prevents the socket terminal from deforming during assembly.

A connector according to a sixth aspect of the invention is a connector wherein the pinch contact part of the plug terminal of the socket terminal has a plurality of contact point parts.

With the first aspect of the invention, forming the housing in a right angle shape makes it possible to secure a sufficient surface distance between the plug terminal and the socket terminal with a single-piece housing, and therefore it is possible to reduce the size of a high voltage connector.

With the second aspect of the invention, folding the contact part so that it is doubled while the plug terminal is formed from a plate material makes the thickness of the pinched contact part approximately double that of the plate thickness, which improves contact stability.

With the third aspect of the invention, the latch is formed in the plug terminal, and therefore it is possible to perform assembly easily by inserting the plug terminal in the plug insertion recessed part of the housing, and thereby assembly productivity is improved.

With the fourth aspect of the invention, the socket terminal is formed from the plate material and the pinch contact part is tubularly formed, thereby making the stability of the connection with the plug terminal excellent.

With the fifth aspect of the invention, forming the base side of the pinch connecting part, which is formed tubularly, in shape such that it mates prevents deformation from occurring when the socket terminal is assembled in the socket connector.

In addition, providing the contact points of the pinch connecting part as a plurality improves connection stability in the case wherein a user replaces a lamp.

BRIEF DESCRIPTION OF THE DRAWINGS

The invention will become more readily apparent from the Detailed Description of the Invention which proceeds with reference to the drawings, in which:

FIGS. 6(*a*) through 6(*e*) illustrate an exemplary socket terminal for the socket connector of FIGS. 5(*a*) and 5(*b*).

DETAILED DESCRIPTION OF THE INVENTION

Figure 1A:
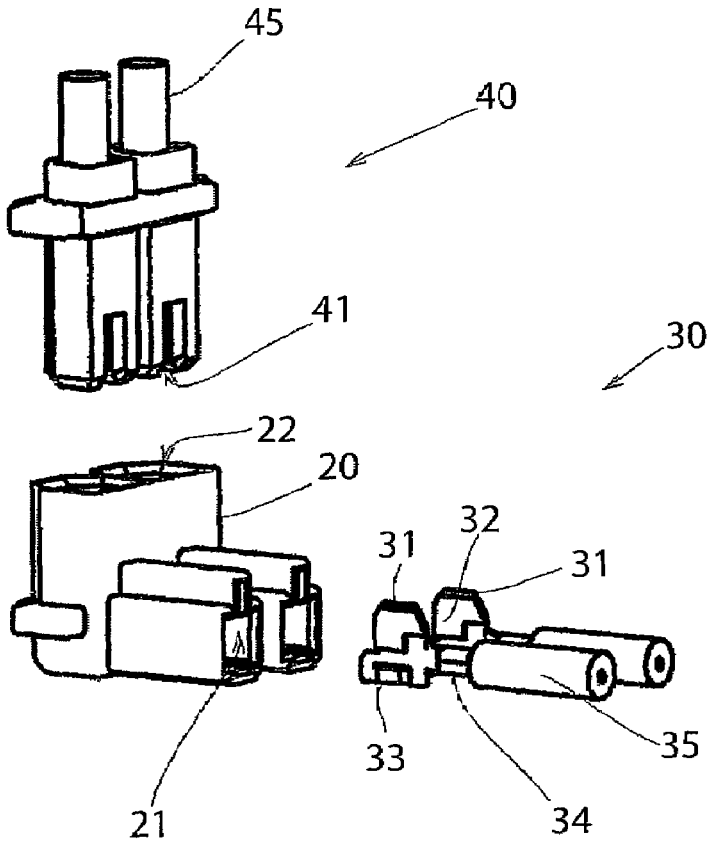
FIGS. 1(*a*) and 1(*b*) illustrate an exemplary connector according to the present invention.

The following legend identifies some of the reference numerals and elements depicted in the drawings:

10 Connector
20 Housing
21 Plug insertion recessed part
22 Socket insertion recessed part
23 Latching part
30 Plug connector
31 Plug terminal
32 Contact part
33 Latch
34 Wire connecting part
35 Plug wire
40 Socket connector
41 Socket terminal
42 Pinch connecting part
44 Wire connecting part
45 Socket wire
46 Stabilizer
47 Mating part
48 Terminal housing part
49 Insertion part A high voltage connector according to the present invention will now be explained, referencing FIG. 1(*a*) through FIG. 8.

A connector 10 according to the present invention comprises an L shaped housing 20, a plug connector 30, and a socket connector 40.

In the housing 20, plug insertion recessed parts 21 and socket insertion recessed parts 22 are formed in an L shape and are in communication.

Figure 7A:
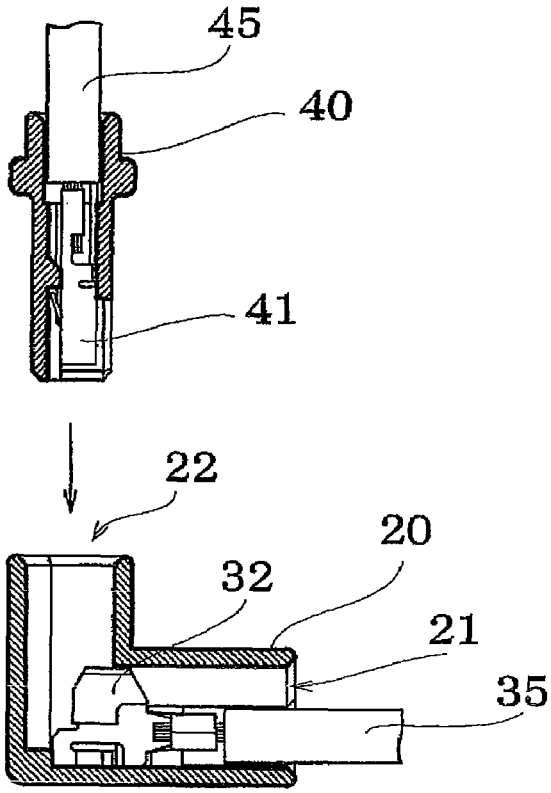
FIGS. 7(*a*) and 7(*b*) show how the housing and socket connector of the connector of FIGS. 1(*a*) and 1(*b*) are connected.
Figure 7B:
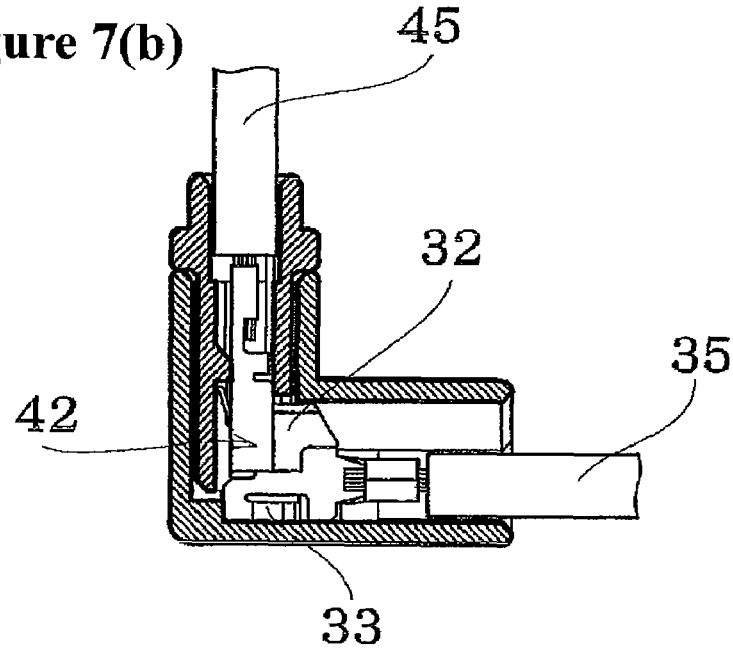

FIGS. 7(*a*) and 7(*b*) show a cross sectional view thereof.

Figure 1B:
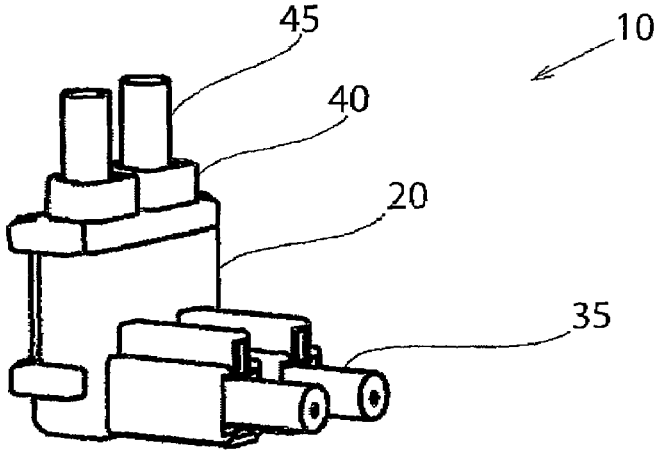
Figure 4A:
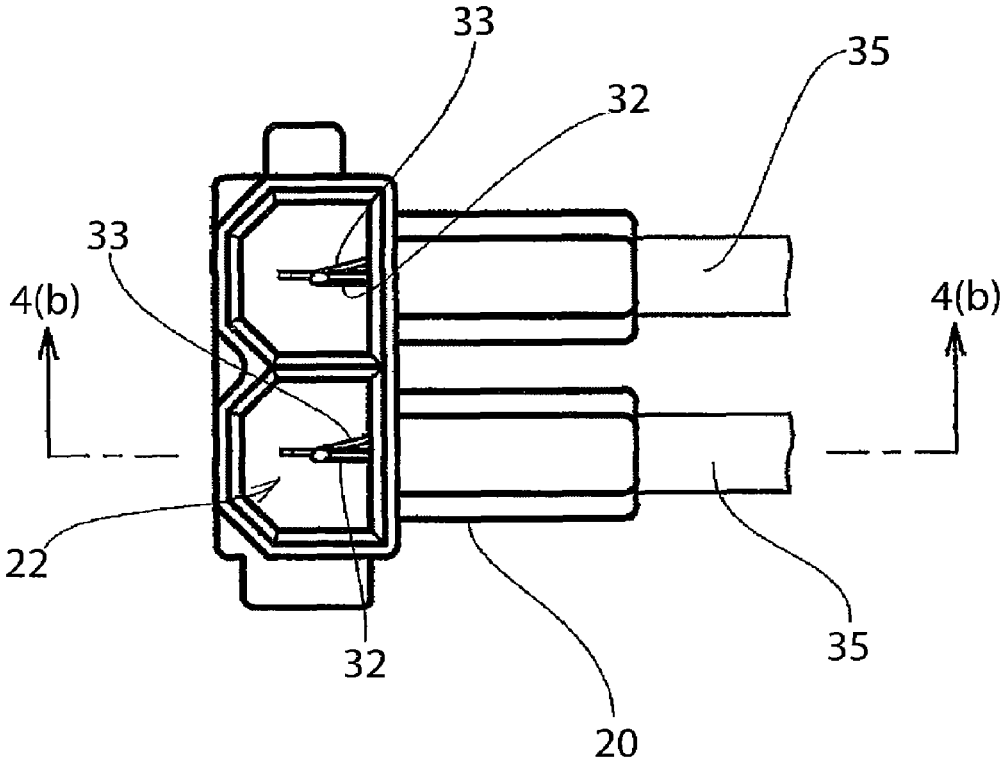
FIGS. 4(*a*) and 4(*b*) further illustrate the state wherein the plug terminal is assembled in the housing of FIG. 2.
Figure 4B:
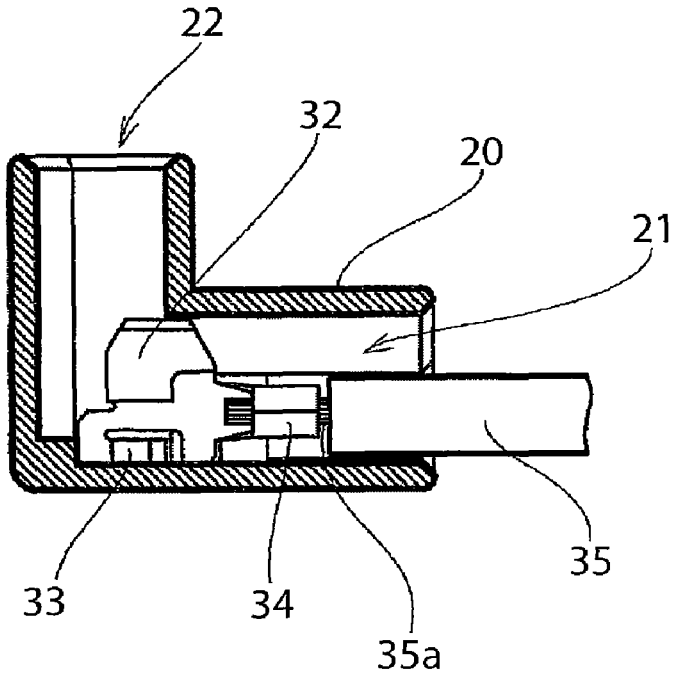

In the plug connector 30 as shown in FIG. 1(*a*) through FIG. 4(*b*), core wires 35*a* of plug wires 35 are crimped by wire connecting parts 34 of plug terminals 31, which are fabricated by folding, e.g., by press working, a single sheet of a plate material.

Each plug terminal 31 has a contact part 32, the upper part of which is folded so that it is doubled, and part of the lower part of which is cut and folded so as to form a latch 33.

Figure 2A:
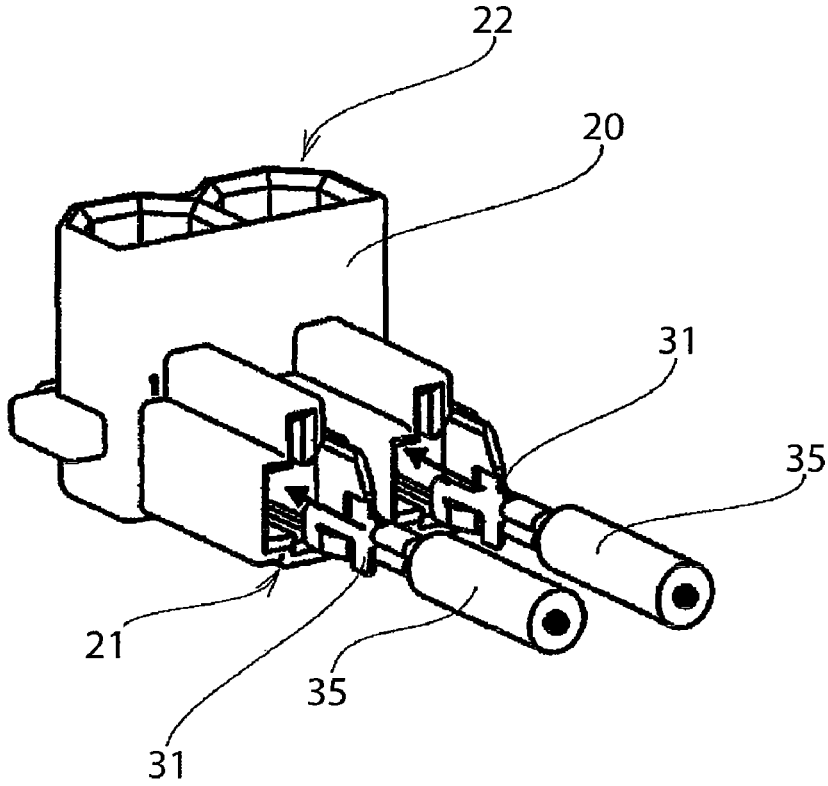
FIGS. 2(*a*) and 2(*b*) show how a plug connector is attached to a housing for the connector of FIGS. 1(*a*) and 1(*b*).
Figure 2B:
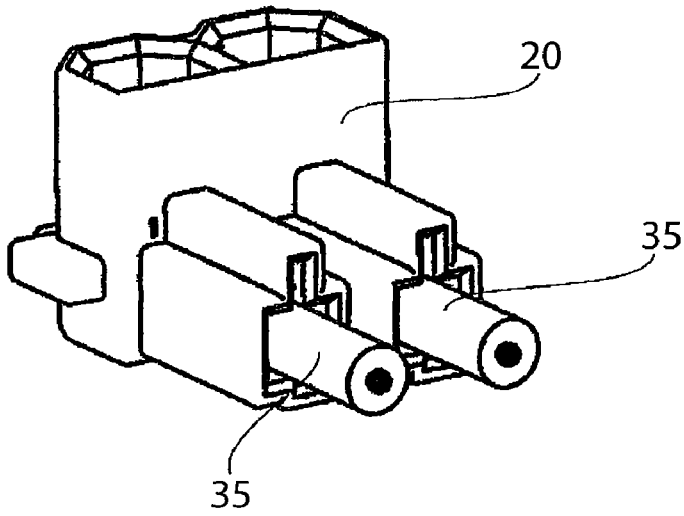
Figure 3A:
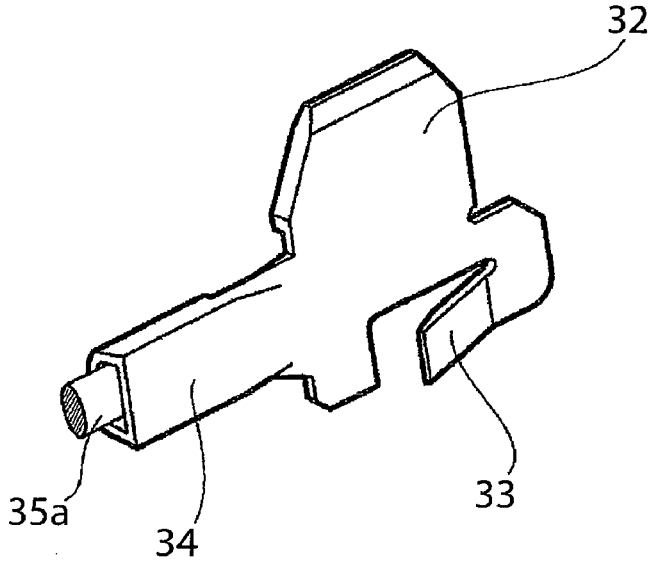
FIGS. 3(*a*) and 3(*b*) show an exemplary structure of a plug terminal as positioned in the housing of FIG. 2.
Figure 3B:
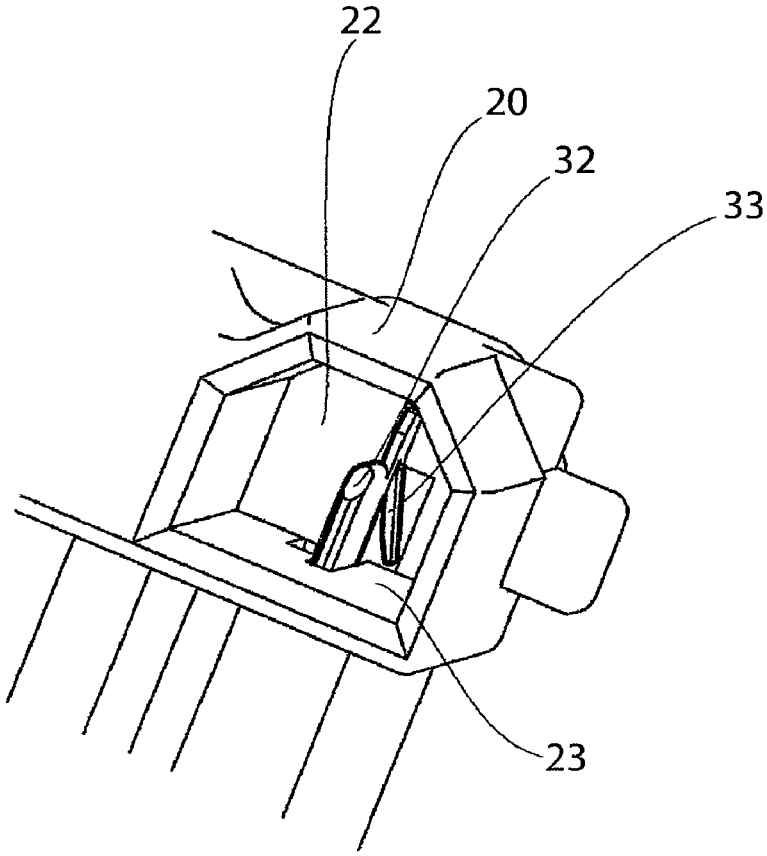

The housing 20 is provided with latching parts 23, one of which is shown in FIG. 3(*b*), and is configured so that assembly can be performed by merely inserting the plug terminals 31, which crimp the plug wires 35, in the plug insertion recessed parts 21 of the housing 20 as shown in FIG. 2(*a*).

FIG. 4(*a*) is a plan view that shows the state wherein the plug terminals 31 are assembled in the housing 20, and FIG. 4(*b*) shows a cross sectional view through the housing 20.

Figure 5A:
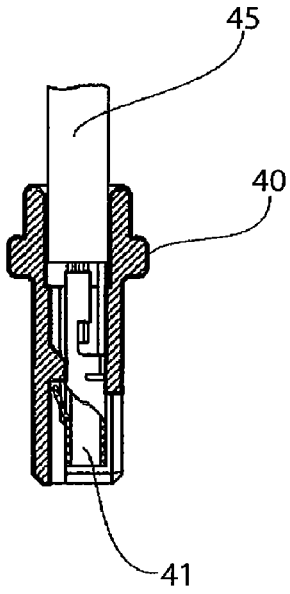
FIGS. 5(*a*) through 5(*c*) illustrate an exemplary socket connector for the connector of FIGS. 1(*a*) and 1(*b*).
Figure 5B:
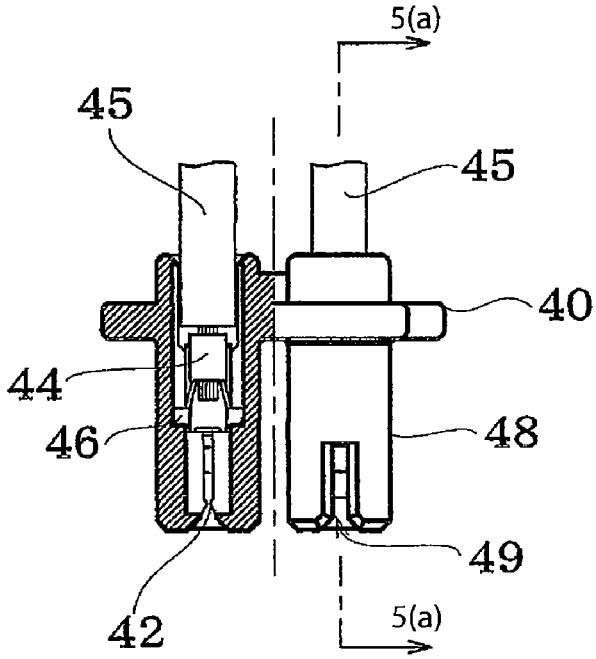
Figure 5C:
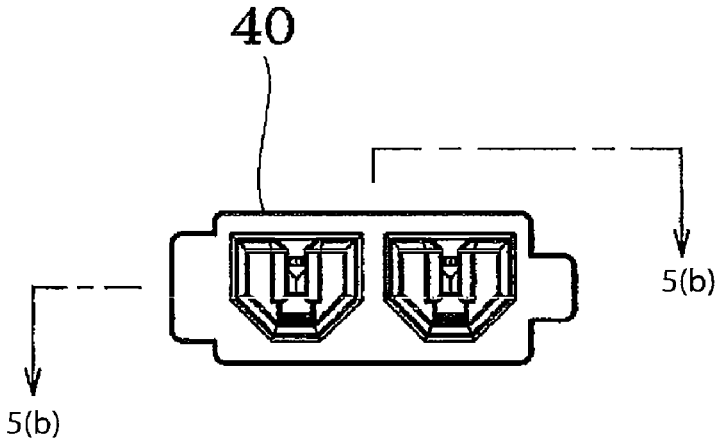

FIGS. 5(*a*) through 5(*c*) show an exemplary structure of the socket connector 40, and FIGS. 6(*a*) through 6(*e*) show an exemplary structure of socket terminals 41.

Each socket terminal 41 comprises a pinch connecting part 42, which is formed by folding a single sheet of a plate material into a tubular shape, and a mating part 47 at its base.

A wire connecting part (crimping part) 44 of a socket wire 45 and a stabilizer 46 are formed at the rear part of each socket terminal 41.

The shape of each socket terminal 41 is not limited to a tube, and may be, for example, elliptical, circular, or rectangular as shown in FIGS. 6(*a*) through 6(*c*), respectively.

A plurality of contact points 42*a* may be formed, one at a time, on both sides of each connecting part 42, which connects to the corresponding plug terminal 31 and the corresponding contact part 32 by pinching them.

The more contact points 42*a* that are formed, the more that contact reliability improves.

In addition, the formation of the mating part 47 in each tubular part prevents deformation from occurring when, for example, the corresponding socket terminal 41 is assembled in a corresponding terminal housing part 48 of the socket connector 40 (as shown in FIG. 5) or when the components are handled.

In addition, an insertion part 49 of each socket terminal 41 is formed in the terminal housing part 48.

As shown in FIGS. 2(*a*), 2(*b*), 7(*a*) and 7(*b*), assembly is performed by inserting each plug terminal 31 into the housing 20; further, when the socket connector 40 is inserted in socket insertion recessed parts 22 of the housing 20, each contact part 32, which is formed by folding the plate material of the plug terminal 31 so that it is doubled, is interferingly pinched by the pinch connecting part 42 of the corresponding socket terminal 41, and is thereby electrically connected thereto.

Thereby, just a small number of parts suffices and a reduction in size can be achieved.

Figure 8:
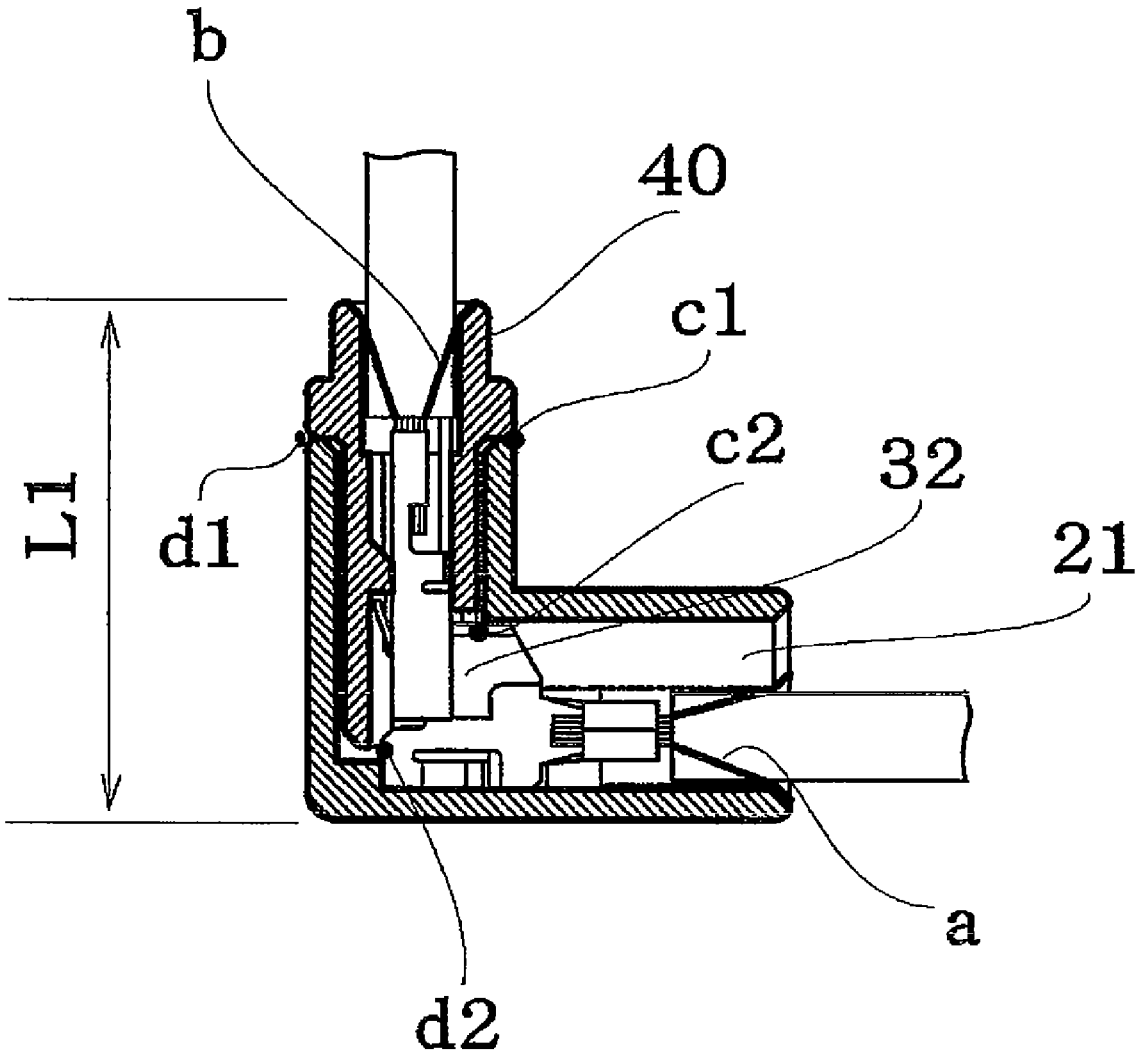
FIG. 8 shows a leakage pathway of the connector.
Figure 9A:
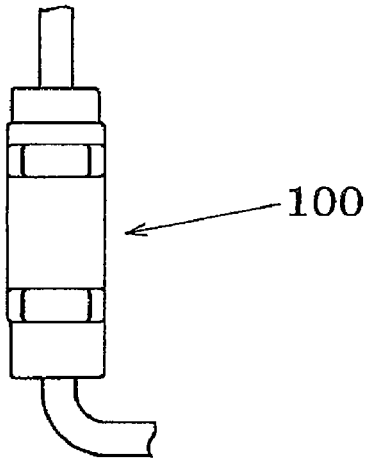
Figure 9(a) (Prior Art)
FIGS. 9(*a*) through 9(*c*) illustrate a conventional straight type connector.
Figure 9B:
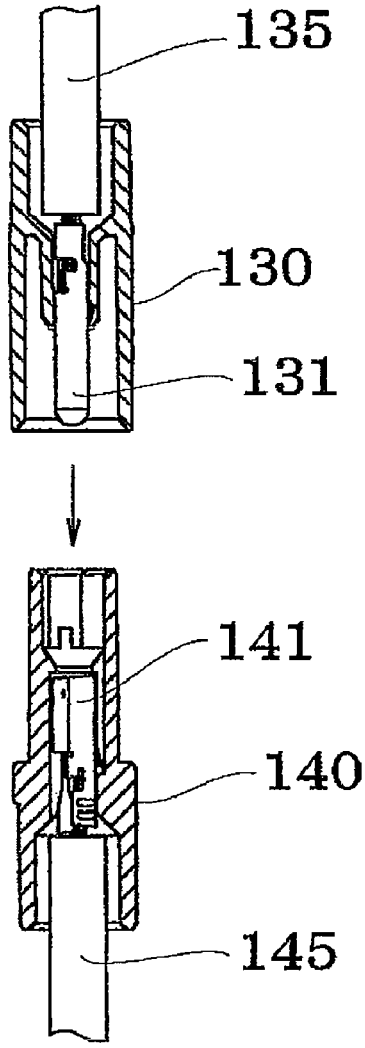
Figure 9(b) (Prior Art)
Figure 9C:
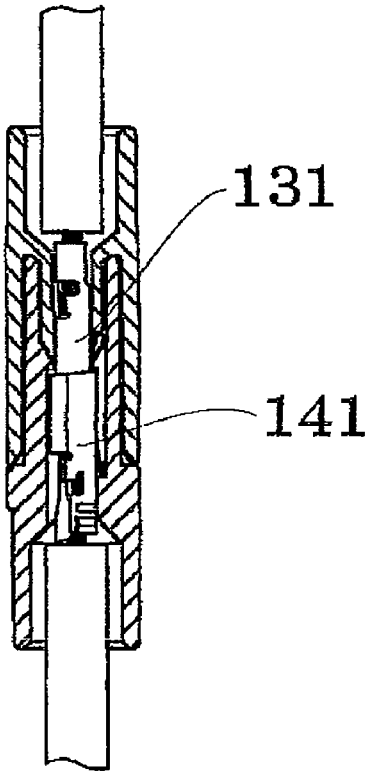
Figure 9(c) (Prior Art)

FIG. 8 shows the surface leakage pathway of the connector 10 according to the present invention.

Reference symbols a, b represent leakage distances of the wire connecting parts, which are determined by the depths of the plug insertion recessed parts 21 and the socket insertion recessed parts 22, respectively.

The distances of the surfaces at which the housing 20 and the socket connector 40 mate are indicated by c1-c2 and d1-d2.

Figure 10A:
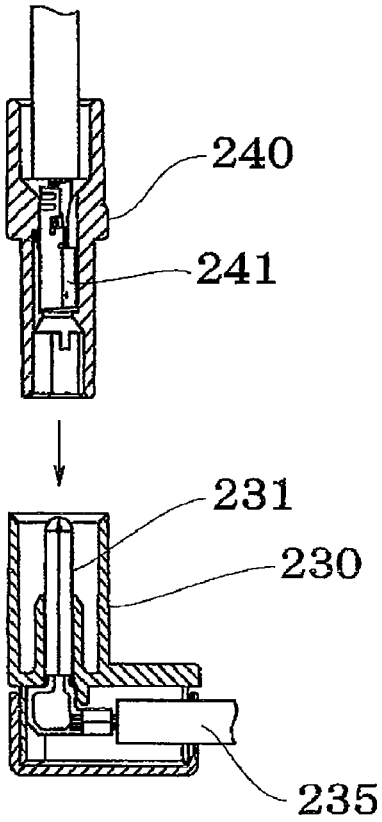
Figure 10(a) (Prior Art)
FIGS. 10(*a*) and 10(*b*) illustrate a conventional L shaped connector.
Figure 10B:
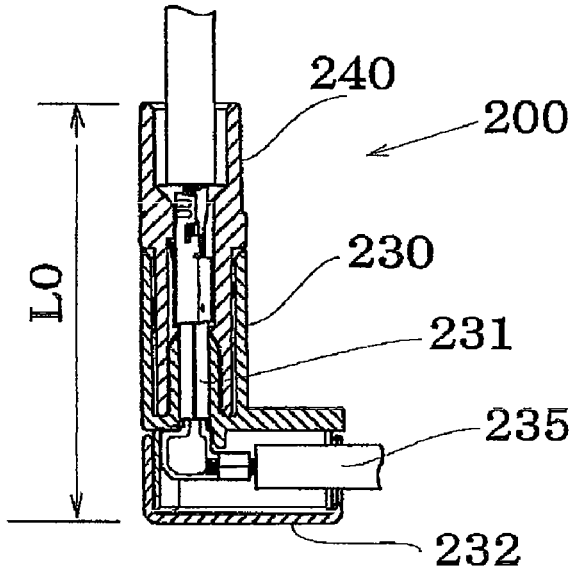
Figure 10(b) (Prior Art)

These distances can be made greater than those in the conventional structure shown in FIGS. 10(*a*) and 10(*b*), and an L1 dimension can be set smaller than the L0 dimension of FIGS. 10(*a*) and 10(*b*).

The invention claimed is:

1. A connector that forms a connection by inserting a socket connector and a plug connector into a housing, wherein the housing includes a plug insertion recessed part and a socket insertion recessed part, the plug insertion recessed part and the socket insertion recessed part being integrally formed in an L shape; and a socket terminal of the socket connector, which is inserted in the socket insertion recessed part, is pinchably connected to a plug terminal of the plug connector, which is fixedly inserted in the plug insertion recessed part, wherein:

a contact part of the plug terminal extends along an insertion direction of the plug insertion recessed part into a base portion of the socket insertion recessed part, the socket insertion recessed part fully encloses the contact part of the plug terminal, the contact part of the plug terminal is pinched by and connected to the socket terminal, the contact part and a wire connecting part of the plug terminal are integrally formed from a plate material; and the contact part is formed by folding the plate material so that it is doubled.

2. The connector according to claim 1, wherein the plug terminal has a latch; and wherein the plug terminal is fixedly inserted by latching the latch to a latching part which is provided in the housing.

3. The connector according to claim 1, wherein the plug terminal has a latch; and wherein the plug terminal is fixedly inserted by latching the latch to a latching part which is provided in the housing.

4. The connector according to of claim 1, wherein the socket terminal comprises a pinch connecting part, which pinches and connects to the plug terminal, and a wire connecting part;

the pinch connecting part and the wire connecting part are integrally formed from the plate material; and the pinch connecting part is formed by folding the plate material into a tubular shape.

5. The connector according to of claim 1, wherein the socket terminal comprises a pinch connecting part, which pinches and connects to the plug terminal, and a wire connecting part;

the pinch connecting part and the wire connecting part are integrally formed from the plate material; and the pinch connecting part is formed by folding the plate material into a tubular shape.

6. The connector according to claim 1, wherein when the socket terminal and the plug terminal are pinchably connected, a first portion of the contact part of the plug terminal is enclosed by the socket terminal and a second portion of the contact part of the plug terminal extends externally from the socket terminal, the first and second portions extending from opposing sides of a pinch connecting part of the socket terminal.

7. The connector according to claim 1, wherein the socket terminal comprises a pinch connecting part, which pinches and connects to the plug terminal, and a wire connecting part;

the pinch connecting part and the wire connecting part are integrally formed from the plate material; and the pinch connecting part is formed by folding a first portion of the plate material into a hollow shape.

8. The connector according to claim 7, wherein:

the hollow shape is a tubular shape, and a mating part is formed at a base side of the pinch connecting part by folding a second portion of the plate material into a tubular shape, whereby edges of the second portion of the tubular shape are abuttingly positioned relative to one another.

9. The connector according to claim 8, wherein the pinch connecting part of the socket terminal has a plurality of contact point parts.

10. The connector according to claim 7, wherein the pinch connecting part of the socket terminal has a plurality of contact point parts.

11. The connector according to claim 7, wherein the pinch connecting part comprises:

a single slot provided in a wall of the hollow shape and extending along an insertion direction of the socket terminal; and one or more pairs of contact points along the slot, the contact points in each pair of contact points being opposingly positioned in the slot.

* * * * *